US006048438A

United States Patent [19]

Rosencrance et al.

[11] Patent Number: 6,048,438

[45] Date of Patent: Apr. 11, 2000

[54] METHOD TO ENHANCE THE PERFORMANCE OF POLYMERS AND COPOLYMERS OF ACRYLAMIDE AS FLOCCULANTS AND RETENTION AIDS

[75] Inventors: Scott W. Rosencrance, Naperville, Ill.; Przemyslaw Pruszynski, Burlington, Canada; Shamel M. Shawki, Naperville, Ill.; Regina Jakubowski; Jeff F. Lin, both of Hamilton, Canada

[73] Assignee: Nalco Chemical Company, Naperville, Ill.

[21] Appl. No.: 08/978,751

[22] Filed: Nov. 26, 1997

Related U.S. Application Data

[63] Continuation-in-part of application No. 08/555,244, Nov. 8, 1995, abandoned.

[51] Int. Cl.[7] ..... D21H 21/10

[52] U.S. Cl. ..... 162/158; 162/163; 162/164.1; 162/168.1; 162/168.3; 162/168.2; 162/183

[58] Field of Search ..... 162/165, 168.1, 162/164.1, 168.3, 183, 158, 163, 168.2; 210/723, 728, 727, 734, 732

[56] References Cited

U.S. PATENT DOCUMENTS

| | | |
|---|---|---|
| 4,070,236 | 1/1978 | Carrard et al. . |
| 4,238,595 | 12/1980 | Girgis . |
| 4,388,150 | 6/1983 | Sunden et al. . |
| 4,643,801 | 2/1987 | Johnson . |
| 4,753,710 | 6/1988 | Langley et al. . |
| 4,772,359 | 9/1988 | Linhart et al. . |
| 4,913,775 | 4/1990 | Langley et al. . |

FOREIGN PATENT DOCUMENTS

| | | |
|---|---|---|
| 621369A1 | 10/1994 | European Pat. Off. . |
| WO 94/17243 | 8/1994 | WIPO . |
| WO 95/21295 | 8/1995 | WIPO . |
| WO 95/21296 | 8/1995 | WIPO . |

OTHER PUBLICATIONS

Database WPI, Section Ch, Week 8017, Derwent Publication, Ltd., London, GB; Class A97, AN 80–30624C, XP002024575 & SU 681 141 A (Leningrad Cell–Paper Ins), Aug. 29, 1979, abstract.

APPT A 83–90, 1995.

Retention Improvement in Difficult Furnishes–K.R. Stack/ L.A. Dunn, APPITA Annual General conference, 83–90, 1995.

Newsprint Papermachine Trials with Polyoxyethylene as a Wet–End Additve, R.H. Pelton, C.H. Tay, L.H. Allen, Journal of Pulp and Pper Science: Jan. 1984, J5–J11.

The Use of Retention Aids in Newsprint Manufacture, A. Barnes, R. Coghill, D. Thurley, Appita, 42(5), 373–375 (1989).

Effect of Eucalpyt Pulp Extractives on the Retention Performance of Polyethylene Oxide and Phenolformaldehyde Resin, K. R. Stack, L. A. Dunn, N. K. Roberts–Appita 45(3), 189–192 (1992).

Evaluation of Various Phenolformaldehyde Resins in the Phenolformaldehyde Resin–Polyethyleneoxide Dual Retention Aid System, Journal of Wood Chemistry and Technology, 13(2), 283–308 (1993).

Study of the Interaction Between Poly(Ethylene Oxide) and Phenol–Formaldehyde Resin, K. Stack, L. Dunn, N. Roberts, Colloids and Surfaces, 61 (1991) 205–218.

Mechanisms of Fines Retention by Polyethylene Oxide in Newsprint Furnishes, L. Rahman, C.H. Tay, Tappi, 69/(4), 100–105, 1986.

Application of Polymeric Flocculant in Newsprint Stock Systems for Fines Retention Improvement, C. H. Tay, Tappi, vol. 63, No. 6, 63–66, 1980.

Newsprint Mill Experience with Wet End Double Polymer Addition for Retention Improvement, S. Shastri, Papermakers Conference, 205–210, 1983.

*Primary Examiner*—Peter Chin

*Attorney, Agent, or Firm*—Margaret M. Brumm; Thomas M. Breininger

[57] ABSTRACT

A method for increasing the separation of solids from an aqueous slurry containing such solids is disclosed. The separation process is particularly useful in the separation of the solid components of a papermill furnish from water in the manufacture of paper. The method comprises the steps of adding to a paper mill slurry from about 0.003 to about 1.0% by weight based on total solids in the slurry of a phenolic enhancer and a nonionic (meth)acrylamide homopolymer methacrylamide, or anionic or cationic flocculant is added to the slurry in an amount of from about 0.003 to about 0.5% by weight based on total solids in the slurry. Addition order is non-critical. The flocculation of solid components of the paper mill slurry is increased leading to improved retention of filler and fiber on the sheet and increased drainage of water from the cellulosic sheet produced. The method is also applicable to the treatment of waste waters, mineral tailings, oily waste waters, municipal and industrial wastes, and the like.

7 Claims, No Drawings

METHOD TO ENHANCE THE PERFORMANCE OF POLYMERS AND COPOLYMERS OF ACRYLAMIDE AS FLOCCULANTS AND RETENTION AIDS

The present application is a continuation-in-part of Ser. No. 08/555,244 filed Nov. 8, 1995 entitled "Method to Enhance the Performance of Polymers and Copolymers of Acrylamide as Flocculants and Retention Aids", now abandoned.

FIELD OF THE INVENTION

The present invention is in the technical field of separating solids from an aqueous slurry containing the solids, and more particularly the separation of solids from a papermill furnish in the manufacture of paper. The process of the instant invention is advantageously employed in the dewatering of waste streams, mineral tailings, the clarification of water, the removal of oily waste from water and more particularly an improved method of making paper.

BACKGROUND OF THE INVENTION

In the manufacture of paper, an aqueous cellulosic suspension or slurry is formed into a paper sheet. The cellulosic slurry is generally diluted to a consistency (percent dry weight of solids in the slurry) of less than 1%, and often below 0.5% ahead of the paper machine, while the finished sheet must have less the 6 weight percent water. Hence the dewatering and retention aspects of paper making are extremely important to the efficiency and cost of the manufacture.

More specifically, the slurry is an aqueous suspension containing cellulosic material and in some cases selected mineral pigments. This slurry is generally diluted to a consistency (percent dry weight of solids in the slurry) of less than 1%, and often below 0.5% ahead of the paper machine. Associated with papermaking slurries, called furnishes, is a large variation in the size and shape of the particles present. These particles may range in size from less than one micrometer for many mineral pigments or fillers, up to several millimeters in their largest dimension for fibers. The initial dewatering of a paper furnish typically takes place by the ejection of the cellulosic furnish onto or between filter fabric(s), called the wire. The openings in these wires are typically on the order of 200 mesh, which corresponds to a hole size capable of passing particles with a diameter of 76 micrometers. If no forces of attraction exist between particles, the mineral pigments would very easily pass through the wire and would not be retained in the sheet, compromising the benefits for which the mineral pigments were added. Thus, under normal papermaking circumstances, many components of the furnish that are small enough to pass through the openings in the wire will require modification if they are to remain in the sheet.

As the fibers form a mat on the wire, they generate their own filter medium and many of the smaller particles in the furnish may be trapped by simple filtration in the fiber mat, particularly if the sheet is thick, i.e. high basis weight. However, even if the basis weight is high, a significant fraction of the small particulate material may not be adequately retained. When basis weights are low or machine turbulence prevents mat formation, the filtration mechanism of small particle retention is extremely inadequate. Under papermaking circumstances when the filtration mechanism is inadequate, chemical treatments generally called retention aids are required to modify the interparticle interactions thereby resulting in coagulation and/or flocculation of the particles.

Retention of small particulate components leads to numerous benefits for the papermaker. Mineral fillers like clay and calcium carbonate are often less expensive than fibers, and substitution of such fillers for fiber provides a way for the papermaker to reduce the raw material costs. Retention of fillers and fiber fines is also necessary to achieve the sheet properties needed for a given end use. Such properties might include sheet opacity, brightness, and appropriate ink interactions. Because the small particles have large surface areas for a given mass, significant amounts of additives such as dyes or sizing agents can be attached to them making retention of the fines necessary for effective utilization of such additives.

Filler particles and fiber fines which are not retained initially, or in the so called first pass, are to a large extent recycled via the white water system back into the furnish, increasing the fraction of small particles present in the furnish over time. This result is often unsatisfactory for several reasons. Some important and expensive materials lose their effectiveness upon recycling in the white water system, and their retention in the first pass is needed for performance or sheet properties. Examples of such materials are titanium dioxide and alkaline sizing agents. Although the total amount of fines in the sheet may be increased in this way, their distribution in the sheet will tend to be very uneven frequently resulting in two-sided phenomena of the paper. In addition, the concentration of unretained materials in a papermachine's white water system can contribute to deposit problems and related runnability problems which result in lost or slowed production and poor product quality. These problems are remedied by using effective retention aids, resulting in a machine with improved runnability, more efficient use of fiber and filler raw materials, and less waste to the mill's waste treatment facility.

Greater retention of fines, fillers, and other slurry components permits, for a given grade of paper, a reduction in the cellulosic fiber content of such paper. As pulps of lower quality are employed to reduce paper making costs, the retention aspect of paper making becomes even more important because the fines content of such lower quality pulps is greater generally than that of pulps of higher quality. Greater retention also decreases the amount of such substances lost to the white water and hence reduces the amount of material wastes, the cost of waste disposal and the adverse environmental effects therefrom. It is desirable to reduce the amount of material employed in a paper making process for a given purpose, without diminishing the result sought. Such add-on reductions may realize both a material cost savings and handling and processing benefits.

Another phenomena of primary interest in papermaking is dewatering. The dewatering method of the least cost in the process is gravity drainage, and thereafter more expensive methods are used, for instance vacuum, pressing, felt blanket blotting and pressing, evaporation and the like, and in practice a combination of such methods are employed to dewater, or dry, the sheet to the desired water content. Since gravity drainage is both the first dewatering method employed and the least expensive, improvement in the efficiency of drainage will decrease the amount of water required to be removed by other methods and hence improve the overall efficiency of dewatering and reduce the cost thereof.

Dewatering generally, and particularly dewatering by drainage, is believed to be improved when the pores of the paper web are less plugged, and it is believed that retention of small particles by adsorption to the fibers in comparison to retention by filtration reduces such pore plugging.

Another important characteristic of a given paper making process is the formation of the paper sheet produced. Formation is determined by the variance in light transmission within a paper sheet, and a high variance is indicative of poor formation. As retention increases to a high level, for instance a retention level of 80 or 90%, the formation parameter generally abruptly declines from good formation to poor formation.

In order to improve retention and drainage in papermaking a flocculant is introduced to induce flocculation. Flocculation describes a number of possible strategies which result in agglomeration of these previously mentioned mall particles. Different degrees of flocculation is required at each stage of operation in pulp and paper mills. At the forming wire on the paper machine, paper is formed by the rapid dewatering of the paper making slurry. This slurry is generally comprised of fibers, fines, mineral fillers and other additives. Under normal conditions, more than 50% of components of the slurry are small enough to pass through the forming wire. In order to retain the smaller components within the structure of the sheet having a low degree of two-sidedness, polymeric retention aids are being used. Such retention aids operate by flocculating of the components of the slurry before the slurry is consolidated as the sheet in the consecutive dewatering stages. The proper level of flocculation is necessary to provide the required retention and drainage rate while not significantly degrading the sheet uniformity-formation.

Various characteristics of the slurry, such as pH, hardness, ionic strength, cationic demand, may affect the performance of a flocculant in a given application. The choice of flocculant involves consideration of the type of charge, charge density, molecular weight, type of monomers and is particularly dependent upon the water chemistry of the mill system being treated.

Hydrolyzable aluminum salts are used extensively as coagulants in papermaking. Because of the acid generated by the aluminum hydrolysis, the pH of machines using alum is depressed, and the process is referred to as "acid papermaking". The aluminum species possessing the greatest coagulating ability are formed in the pH range of 4 to 6. Polyaluminum chlorides are also effective coagulants. Being partially neutralized, they do not depress the pH to the extent that alum does and are generally more applicable over a wider pH range.

In a single polymer program, a flocculant, typically a cationic polymer, is the only material added. Another method of improving the flocculation of cellulosic fines, mineral fillers and other furnish components on the fiber mat is the dual polymer program, also referred to as a coagulant/flocculant system, added ahead of the paper machine. In such a system there is first added a coagulant, for instance a low molecular weight synthetic cationic polymer or cationic starch to the furnish, followed by the addition of a flocculant. Such flocculants generally are a high molecular weight synthetic polymers which bind the particles into larger agglomerates. The presence of such large agglomerates in the furnish as the fiber mat of the paper sheet is being formed increases retention. The agglomerates are filtered out of the water onto the fiber web, whereas unagglomerated particles would to a great extent pass through such paper web.

In systems containing high concentrations of anionic polymeric/oligomeric substances, the performance of cationic polymers is often detrimentally affected. These anionic substances may be of inorganic or organic origin. Silicates used as hydrogen peroxide stabilizers in pulping, bleaching, and de-inking processes and species extracted from the wood like polygalacturonic acids and lignin derivatives are the most typical examples of components of anionic detrimental substances, also called "anionic trash". Nonionic and anionic polymers are affected by these substances to a much lower degree than cationic polymers.

An example of a papermaking program which utilizes a nonionic flocculent is disclosed by Linhart et al., U.S. Pat. No. 4,772,359 as a process to increase drainage rate and the retention of fillers, fines and pigments which comprises adding to the pulp slurry an effective amount of a high molecular weight water-soluble polymer of an N-substituted vinylamide. It is well known that vinylamides, in the presence of acid, can hydrolyze to yield a substance which contains cationic moiety. Cationic moieties are very effective at inducing flocculation in papermaking slurries as well as inducing flocculation in these system.

The Linhart et al. reference does not show that a combination of resin and nonionic homopolymer acrylamide may be utilized advantageously. Poly(acrylamide) is only used as a control in these examples.

Upon reference to Table 4 of the '359 patent, it is apparent that cationic polyacrylamide and resin in combination do not provide any added performance over polymer alone. For polymer I, drainage time decreases by 1 unit, from 89 to 88. Optical transparency increases from 53 to 57, a change of 4 units. Both of these changes are within experimental error, and thus do not illustrate any advantage of adding polymer and resin together. One skilled in the art reading this reference and analyzing this set of data would not pursue such a combination, based on the lack of increased efficiency demonstrated by Table 4.

Upon reference to Table 5, it is apparent that the use of nonionic polyacrylamide does not lead to any increase in efficiency. If the polymer and resin combination is compared to phenol alone, drainage is decreased from 139 to 138, a change of only one unit. The optical transparency decreased from 35 to 31, a change of four units. Both of these results are within experimental error, and actually teach that the addition of resin and polymer do not provide any advantages over the addition solely of resin. Furthermore, the optical transparency data would suggest that the resin/polyacrylamide combination negatively impacts retention as evidenced by a decrease in optical transparency. However, this interpretation also does not consider the inherent error associated with the experimental method. Therefore, one skilled in the art analyzing Table 5, would not be taught that non-ionic polymer/resin combinations increase efficiency.

Therefore an examination of the data of Tables 4 or 5 of the Linhart et al. reference would not lead one skilled in the art to believe that there would be any inherent advantage to a combination of polymer and resin, when the polymer is a cationic or non-ionic polyacrylamide, for this reference illustrates no effect. One skilled in the art upon reading the Linhart reference would therefore not pursue the use of a combination when attempting to ameliorate the operation of the papermaking systems described by the instant invention.

Another example of a dual polymer system utilizing a nonionic flocculant is the polyethylene oxide (PEO) and cofactor program. PEO is an effective retention aid for newsprint and other mechanical pulp furnishes. Known cofactors include kraft lignin, sulfonated kraft lignin, naphthalene sulfonate, tannin extract, and water-soluble phenol-formaldehyde resins. A recent EPO patent application (Echt, EP 621 369 A1, 1995), discloses using poly(p-vinyl phenol) as a cofactor.

The method disclosed in the Carrard et al., U.S. Pat. No. 4,070,236 describes the use of poly(ethylene oxide), referred to as PEO, having a molecular weight in excess of 1,000,000 with water soluble phenol-formaldehyde or naphthol-formaldehyde resins or sulphur resins. The Carrard et al reference also discusses the use of other polymers in conjunction with the above mentioned two-component program. Such polymers include polyamide amine, polyalkylene imine, polyamine (all cationic) and polyacrylic-polyacrylamide copolymer (anionic).

In the APPITA Annual General Conference report, 83–90, 1995, an improvement in the performance of PEO/phenolic enhancer programs was discussed. The improvement was the result of adding cationic polyacrylamide to PEO/phenolic enhancer programs. The synergy exists between the PEO/resin combination and the cationic polyacrylamide.

However, there are problems associated with the use of PEO as a retention aid. PEO is expensive when compared to many synthetic flocculants. Also, PEO chains are susceptible to degradation which results in lowering the molecular weight and thus flocculation efficiency. Degradation can be caused by either shear forces or extended storage. In addition, PEO is susceptible to oxidizing agents that may be present in the furnish.

In an attempt to circumvent these difficulties, Huinig Xiao and R. Pelton, reported synthesis of a nonionic copolymer of acrylamide and poly(ethylene-glycol) methacrylate. This copolymer contains pendant PEG chains intended to impart PEO like character and thus activity, as claimed by Xiao and Pelton, via interaction with resole-type phenolic enhancer to form the three dimensional structures responsible for its good performance as a retention polymer. However, Xiao and Pelton did not report any beneficial effect from the use of phenolic enhancer on flocculation performance of polyacrylamide homopolymers. This information has been presented in PCT/CA94/00021.

Furthermore, flocculation can be beneficial in applications other than wet-end papermaking. Among these are applications such as saveall clarification. The save-all is used to separate solids which are agglomerated in the white water and keep such solids within the paper making system. Proper operation of the save-all is very important for economical use of cellulosic raw materials, fines and other additives. It is also important to minimize the environmental impact of the effluent stream with lower suspended solids, lower COD and BOD values and reduced amounts of solid waste materials.

Clarifiers, dissolved air floatation units (DAF), are used to separate the suspended and colloidal solids from the waste water streams from paper mills, pulp mills, and de-inking facilities. Effective solids removal allows for an increase in the recycling of water used in the system, thereby reducing the consumption of fresh water.

Flocculation is also used in sludge dewatering presses. The presses are used to concentrate the solid waste materials. The appropriate operation of such presses reduces the costs and other problems associated with the disposal of solid waste materials and lowers the environmental impact of such materials.

The most significant flocculation applications include alum and derivatives of aluminum, single cationic polymer programs, dual polymer programs, and microparticle programs.

The present invention departs from previously disclosed claims regarding papermaking as well as other applications where separation of solids from aqueous liquids is important. This patent discloses the novel use of a phenolic enhancer to be added to a papermaking slurry either before or after a period of high shear. The phenolic enhancer can also be added either before or after a flocculant. The flocculants used may be either anionic or nonionic. A synergistic interaction is observed when the phenolic enhancer and the flocculant are added in the disclosed manner. This unique combination of components as well as their mode of addition constitute the novel, surprising and unexpected invention not obvious to one skilled in the art disclosed herein. This invention allows improved levels of retention, formation, uniform porosity, and overall dewatering in the papermaking process. Furthermore, this process is responsible for improved flocculation. While the invention has been, and will be described particularly in reference to the manufacture of paper those skilled in the art will readily appreciate that the method using the phenolic enhancer and water soluble polymeric flocculant will be applicable to a wide variety of processes in which solids are separated from aqueous liquids, or conversely when aqueous liquids are separated from solids. The improved separation techniques taught herein can be beneficially applied to applications other than pulp and paper systems, for example, where ever solid/liquid separation or emulsion breaking are performed. Examples of such applications are municipal and industrial sludge dewatering, clarification or raw waters, the dewatering of aqueous mineral slurries, the removal of oils and greases from waste waters and the like.

SUMMARY OF THE INVENTION

A method for increasing the flocculation of solid components of a paper making furnish in a paper making system which comprises the steps of adding to a paper making furnish from about 0.003 to about 1.0% by weight based on total solids in the furnish of a phenolic enhancer. An anionic or nonionic flocculant is added to the furnish in the amount of from about 0.003 to about 0.5% by weight based on total solids in the furnish either before or after the phenolic additive. The flocculation of solid components of the paper making furnish is increased wherein improved levels of retention, formation, uniform porosity, and overall dewatering are obtained. As used herein the term furnish is meant to describe the aqueous mixture of cellulosic fiber, fillers, and other paper making components which are formed into a cellulosic sheet by the removal of water.

DESCRIPTION OF THE INVENTION

The present invention clearly shows surprising improvement in flocculation activity when certain anionic and nonionic acrylamide flocculants are used in tandem with select enhancers. Specifically, the present invention shows the use of phenol-formaldehyde resins and tannins as enhancers in retention programs.

The invention is a method for improving the retention of fillers and fibers and improving drainage in the formation of a cellulosic sheet. This method, which is often performed on a papermachine comprises the steps of adding to a paper making furnish from about 0.003 to about 1.0% by weight based on total solids in the furnish of phenolic enhancer and ananionic or nonionic acrylamide flocculant in the amount of from about 0.003 to about 0.5% by weight based on total solids in the furnish. Either the enhancer or the flocculant may be added first although laboratory experiments appear to indicate better results when the phenolic enhancer is added as the first component to the slurry or furnish.

The dosage of the flocculant is preferably from about 0.003 to about 0.5% by weight based on total solids in the slurry, more preferably from about 0.007 to about 0.2 % and most preferably from about 0.02 to about 0.1%. The dosage of phenolic enhancer is preferably from about 0.003 to about 1.0% by weight based on total solids in the slurry, more preferably from about 0.007 to about 0.5% and most preferably from about 0.02to about 0.3%.

In either aspect, a detrimental substances controlling additive such as bentonite, talc or mixtures thereof may be added anywhere to the system. A preferred addition point for the additive is the thick stock pulp before dilution with white water. This application results in increased cleanliness of the paper making operation which otherwise experiences hydrophobic deposition affecting both the productivity and the quality of paper.

In some cases a cationic coagulant must be added to the slurry. The dosage of coagulant is preferably from about 0.001 to about 4% by weight based on total solids in the slurry, more preferably from about 0.01 to about 2% and most preferably from about 0.02 to about 1%. The addition point of the coagulant can be either before or after either the enhancer and/or the flocculant.

In addition, either aspect may be applied to paper mill slurry selected from the group consisting of fine paper, board, and newsprint paper mill slurries. The slurries include those that are wood-containing, wood-free, virgin, recycled and mixtures thereof. The phenolic enhancer is selected from a group consisting of phenol-formaldehyde resins, tannin extracts, naphthol-formaldehyde condensates, poly (para-vinyl phenol), and mixtures thereof. As utilized herein, the term phenolic enhancer is meant to encompass substituted versions of the above enhancer materials where the substituted functionality includes but is not limited to moieties such as carboxylates, sulfonates and phosphonates. Tannin extracts, as the term is utilized herein refer to naturally occurring polyphenolic substances that are present in the organic extracts of bark of some wood species.

Another aspect of the invention is a method for increasing retention and drainage of a paper making furnish in a paper making machine which comprises the steps of adding to a paper making furnish from about 0.003 to about 1.0% by weight based on total solids in the furnish of phenolic enhancer. Anionic or nonionic acrylamide flocculant is then added to the furnish in the amount of from about 0.003 to about 0.5% by weight based on total solids in the furnish.

Another aspect of the invention is a method for increasing retention and drainage of a paper making furnish in a paper making machine which comprises the steps of adding to a paper making furnish from about 0.003 to about 0.5% by weight based on total solids in the furnish of an anionic or nonionic acrylamide flocculant. Phenolic enhancer is then added to the furnish in the amount of from about 0.003 to about 1.0% by weight based on total solids in the furnish.

The dosage of the anionic or nonionic acrylamide flocculant is preferably from about 0.003 to about 0.5% by weight based on total solids in the furnish, more preferably from about 0.007 to about 0.2% and most preferably from about 0.02 to about 0.1%. The dosage of phenolic enhancer is preferably from about 0.003 to about 1.0% by weight based on total solids in the furnish, more preferably from about 0.007 to about 0.5% and most preferably from about 0.02 to about 0.3%.

In either aspect, the detrimental substances controlling additive such as talc and/or bentonite may be added anywhere to the system. Their preferred addition point is the thick stock pulp before dilution with white water. This application results in increased cleanliness of the paper making operation which otherwise experiences hydrophobic deposition affecting both the productivity and the quality of paper.

In some cases a cationic coagulant must be added to the slurry. The dosage of coagulant is preferably from about 0.001 to about 4% by weight based on total solids in the slurry, more preferably from about 0.01 to about 2% and most preferably from about 0.02 to about 1%. The addition point of the coagulant can be either before or after either the enhancer and/or the flocculant.

In addition, either aspect may be applied to paper making furnish selected from the group consisting of fine paper, board, and newsprint paper making furnishes. The methods also apply more generally to any slurries obtained from the following processes: water clarification, sludge dewatering and dissolved air flotation. The furnishes include those that are wood-containing, wood-free, virgin, recycled and mixtures thereof. Phenolic enhancer is selected from a group consisting of phenol-formaldehyde resins, tannin extracts, naphthol-formaldehyde condensates, poly(para-vinyl phenol), and mixtures thereof.

The high molecular weight anionic polymers used in this application of this invention are preferably water-soluble vinyl copolymers of acrylamide or (meth)acrylamide with following monomers: acrylic acid, 2-acrylamido-2-methylpropane sulfonate (AMPS) and mixture thereof. The anionic high molecular weight flocculants may also be either hydrolyzed acrylamide polymers or copolymers of acrylamide or its homologues, such as methacrylamide, with acrylic acid or its homologues, such as methacrylic acid, or with monomers, such as maleic acid, itaconic acid, vinyl sulfonic acid, AMPS, or other sulfonate containing monomers. The anionic polymers may be sulfonate or phosphonate containing polymers which have been synthesized by modifying acrylamide polymers in such a way as to obtain sulfonate or phosphonate substitutions, or mixtures thereof. The most preferred high molecular weight anionic flocculants are acrylic acid/acrylamide copolymers, and sulfonate containing polymers such as 2-acrylamide-2-methylpropane sulfonate/acrylamide copolymer (AMPS), acrylamido methane sulfonate acrylamide (AMS), acrylamido ethane sulfonate/acrylamide (AES) and 2-hydroxy-3-acrylamide propane sulfonate/acrylamide (HAPS).

The dosage of the anionic flocculant is preferably from about 0.003 to about 0.5% by weight based on total solids in the furnish, more preferably from about 0.007 to about 0.2% and most preferably from about 0.02 to about 0.1%. The dosage of phenolic enhancer is preferably from about 0.003 to about 1.0% by weight based on total solids in the furnish, more preferably from about 0.007 to about 0.5% and most preferably from about 0.02 to about 0.3%.

It is preferred that the flocculants have a molecular weight of at least about 500,000 to about 30,000,000. A more preferred molecular weight is at least about 1,000,000 to about 30,000,000 with the best results observed when molecular weight is between about 5,000,000 to about 30,000,000. The anionic content of copolymers can range from about 0 to about 100 mole % of the copolymer, with best results observed the range of about 0.1 to about 30 mole % of anionic charge. These high molecular weight flocculants may be used in the solid form, as an aqueous solution, as water-in-oil emulsion or as dispersion in water.

Other additives may be charged to the cellulosic slurry without any substantial interference with the activity of the present invention. Such other additives include for instance sizing agents, such as alum and rosin, pitch control agents, extenders such as anilex, biocides and the like.

The nonionic flocculants useful in the practicing of this invention can be formed from at least one of the monomers chosen from the group consisting of acrylamide, methacrylamide, and N-tertiary butyl acrylamide, among others.

The dosage of the nonionic flocculant is preferably from about 0.003 to about 0.5% by weight based on total solids in the furnish, more preferably from about 0.007 to about 0.2% and most preferably from about 0.02 to about 0.1%. The dosage of phenolic enhancer is preferably from about 0.003 to about 1.0% by weight based on total solids in the furnish, more preferably from about 0.007 to about 0.5% and most preferably from about 0.02 to about 0.3%.

It is preferred that these flocculants have a molecular weight of at least about 500,000 to about 30,000,000. A more preferred molecular weight is at least about 1,000,000 to about 30,000,000 with the best results observed when molecular weight is between about 5,000,000 to about 30,000,000. These high molecular weight flocculants may be used in the solid form, as an aqueous solution, as water-in-oil emulsion or as dispersion in water.

Other additives may be charged to the cellulosic slurry without any substantial interference with the activity of the present invention. Such other additives include for instance sizing agents, such as alum and rosin, pitch control agents, extenders such as anilex, biocides and the like.

The process as disclosed in the application are believed to be applicable to all grades and types of paper products that contain the fillers described herein, and further applicable for use on all types of pulps including, without limitation, chemical pulps, including sulfate and sulfite pulps form both hardwood and softwood, and mechanical pulps including but not limited to thermo-mechanical and groundwood.

The increased flocculation properties of this invention can be applied to applications other than pulp and paper systems, for example, where ever solid/liquid separation or emulsion breaking are performed. Examples of such applications are municipal sludge dewatering, clarification and dewatering of aqueous mineral slurries.

The part of the invention is a method for increasing flocculation for applications such as sludge dewatering and clarification. comprises the steps of adding to a slurry from about 0.003 to about 1.0% by weight based on total solids in the slurry of phenolic enhancer. Anionic, cationic or nonionic acrylamide flocculant is then added to the slurry in the amount of from about 0.003 to about 0.5% by weight based on total solids in the slurry.

Another aspect of the invention is a method for increasing flocculation for applications such as sludge dewatering and clarification which comprises the steps of adding to a slurry from about 0.003 to about 0.5% by weight based on total solids in the slurry of an anionic, cationic or nonionic acrylamide flocculant. Phenolic enhancer is then added to the slurry in the amount of from about 0.003 to about 1.0% by weight based on total solids in the slurry.

The dosage of the flocculant is preferably from about 0.003 to about 0.5% by weight based on total solids in the slurry, more preferably from about 0.007 to about 0.2% and most preferably from about 0.02 to about 0.1%. The dosage of phenolic enhancer is preferably from about 0.003 to about 1.0% by weight based on total solids in the slurry, more preferably from about 0.007 to about 0.5% and most preferably from about 0.02 to about 0.3% on the same basis.

In some cases a cationic coagulant must be added to the slurry. The dosage of coagulant is preferably from about 0.001 to about 4% by weight based on total solids in the slurry, more preferably from about 0.01 to about 2% and most preferably from about 0.02 to about 1%. The addition point of the coagulant can be either before or after either the enhancer and/or the flocculant.

The phenolic enhancer is selected from a group consisting of phenol-formaldehyde resins, tannin extracts, naphthol-formaldehyde condensates, poly(para-vinyl phenol), and mixtures thereof.

The high molecular weight anionic polymers used in this application of this invention are preferably water-soluble vinyl copolymers of acrylamide or (meth)acrylamide with following monomers: acrylic acid, 2-acrylamido-2-methylpropane sulfonate (AMPS) and mixture thereof. The anionic high molecular weight flocculants may also be either hydrolyzed acrylamide polymers or copolymers of acrylamide or its homologues, such as methacrylamide, with acrylic acid or its homologues, such as methacrylic acid, or with monomers, such as maleic acid, itaconic acid, vinyl sulfonic acid, AMPS, or other sulfonate containing monomers. The anionic polymers may be sulfonate or phosphonate containing polymers which have been synthesized by modifying acrylamide polymers in such a way as to obtain sulfonate or phosphonate substitutions, or mixtures thereof. The most preferred high molecular weight anionic flocculants are acrylic acid/acrylamide copolymers, and sulfonate containing polymers such as 2-acrylamide-2-methylpropane sulfonate/acrylamide copolymer (AMPS), acrylamido methane sulfonate acrylamide (AMS), acrylamido ethane sulfonate/acrylamide (AES) and 2-hydroxy-3-acrylamide propane sulfonate/acrylamide (HAPS).

The dosage of the anionic flocculant for this part of the invention is preferably from about 0.003 to about 0.5% by weight based on total solids in the furnish, more preferably from about 0.007 to about 0.2% and most preferably from about 0.02 to about 0.1%. The dosage of phenolic enhancer is preferably from about 0.003 to about 1.0% by weight based on total solids in the furnish, more preferably from about 0.007 to about 0.5% and most preferably from about 0.02 to about 0.3%.

It is preferred that the anionic flocculants for this part of the invention have a molecular weight of at least about 500,000 to about 30,000,000. A more preferred molecular weight is at least about 1,000,000 to about 30,000,000 with the best results observed when molecular weight is between about 5,000,000 to about 30,000,000. The anionic content of copolymers can range from about 0 to about 100 mole % of the copolymer, with best results observed the range of about 0.1 to about 30 mole % of an anionic charge. These high molecular weight flocculants may be used in the solid form, as an aqueous solution, as water-in-oil emulsion or as dispersion in water.

The nonionic flocculants useful in the practicing this part of the invention can be formed from at least one of the monomers chosen from the group consisting of acrylamide, methacrylamide, and N-tertiary butyl acrylamide, among others.

The dosage of the nonionic flocculant is for this application of the invention is preferably from about 0.003 to about 0.5% by weight based on total solids in the furnish, more preferably from about 0.007 to about 0.2% and most preferably from about 0.02 to about 0.1%. The dosage of phenolic enhancer is preferably from about 0.003 to about 1.0% by weight based on total solids in the furnish, more preferably from about 0.007 to about 0.5% and most preferably from about 0.02 to about 0.3%.

It is preferred that the nonionic flocculants used in this application of the invention have a molecular weight of at least about 500,000 to about 30,000,000. A more preferred molecular weight is at least about 1,000,000 to about 30,000,000 with the best results observed when molecular weight is between about 5,000,000 to about 30,000,000. These high molecular weight flocculants may be used in the solid form, as an aqueous solution, as water-in-oil emulsion or as dispersion in water.

The cationic flocculants used in the application of this part of the invention are any water-soluble copolymer of acrylamide or methacrylamide which carries or is capable of carrying the cationic charge when dissolved in water, whether or not this charge-carrying capacity is dependent upon pH. The cationic copolymers include the following examples which are not meant to be limiting on this invention: copolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA HCl), diallyldimethylammonium chloride (DADMAC), methacrylamidopropyltrimethylammonium chloride (MAPTAC) and allyl amine (ALA).

The dosage of the cationic flocculent for this part of the invention is preferably from about 0.003 to about 0.5% by weight based on total solids in the furnish, more preferably from about 0.007 to about 0.2% and most preferably from about 0.02 to about 0.1%. The dosage of phenolic enhancer is preferably from about 0.003 to about 1.0% by weight based on total solids in the furnish, more preferably from about 0.007 to about 0.5% and most preferably from about 0.02 to about 0.3%.

It is preferred that the cationic flocculants for this part of the invention have a molecular weight of at least about 500,000 to about 30,000,000. A more preferred molecular weight is at least about 1,000,000 to about 30,000,000 with the best results observed when molecular weight is between about 5,000,000 to about 30,000,000. The anionic content of copolymers can range from about 0 to about 100 mole % of the copolymer, with best results observed the range of about 0.1 to about 30 mole % of an anionic charge. These high molecular weight flocculants may be used in the solid form, as an aqueous solution, as water-in-oil emulsion or as dispersion in water.

The coagulants useful in this invention are typically cationic polymers having a low molecular weight of at least about 1,000 and less than about 500,000. More preferably, the molecular weights range from about 2,000 to about 200,000.

Examples of polymers used as coagulants include copolymers formed from diallyldimethylammonium chloride and monomers selected from the group consisting of quaternized dimethylaminoethylacrylates, quaternized dimethylaminomethacrylates, vinyltrimethoxysilane, acrylamide, diallyldimethylaminoalky(meth)acrylate, diallyldimethylaminoalkyl)meth)acrylamide and mixtures thereof. In addition, polymers that can be used include polyethylene imines, polyamines, polycyanodiamide formaldehydes, poly(diallyldimethylammonium chloride), poly(diallyldimethylaminoalkyl(meth)acrylates), poly (diallyldimethylaminoalkyl(meth)acrylamides, condensation polymers of dimethyl amine and epichlorohydrin as well as copolymers formed from acrylamide and/or diallyldimethylaminoalkyl(meth)acrylates and diallyldimethylaminoalkyl(meth)acrylamides, condensation polymers of ammonia and ethylene dichloride or copolymers formed from acrylamido N,N-dimethyl piperazine quaternary salt and acrylamide.

Polymeric coagulants applicable to this invention may also include poly(vinylamines) such as those formed from at least one monomer selected from the group consisting of amidine vinylformamide, vinyl alcohol, vinyl acetate, vinyl pyrrolidinone, polymerized with the esters, amides nitrites or salts of (meth)acrylic acid. Additionally, the coagulant may be an inorganic material such as alum. Procedures used include:

1. Britt Jar for evaluation of FPR (first pass retention), FPAR (first pass ash retention) and SD (suction drainage).

First Pass Retention (FPR) is a measure of a degree of incorporation of solids into the formed sheet. It is calculated from the consistency of the paper making slurry CS and consistency of white water C. resulting during the sheet formation:

$$FPR=((C_s-C_{ww})/C_s)\times 100\%$$

First Pass Ash retention (FPAR) is a measure of the degree of incorporation of filler into the formed sheet. It is calculated from the filler consistencies in the initial paper making slurry $C_{fs}$ and filler consistency of white water $C_{fww}$ resulting during the sheet formation:

$$FPAR=((C_{fs}-C_{fww})/C_{fs})\times 100\%$$

Suction drainage (SD) is a time required to filter a sample of white water through the standard filter paper such as Whatman 41. SD has been found to be a good indication of retention and specific filtration resistance, as a lower SD value indicates a greater efficiency SD is used as a quick test indicating the polymer performance.

The Britt Jar test is an industry-approved laboratory evaluation of FPR and FPAR. The Britt Jar consists of a baffled container, an impeller, a screen through which drainage occurs (typically 200–70 mesh) and a valve. It is used to duplicate paper machine shear conditions. A sample of stock having a known consistency is placed in the Britt Jar while the impeller is in operation. The stock is then treated with diluted solutions of retention polymers in a sequence which best reflects paper machine addition points. At the end of experiment, a sample of white water, typically 100 ml, is collected under dynamic conditions. Dynamic conditions during the drainage should prevent mat formation.

Consistency of the stock used for the experiments was between 0.2 and 0.7%. In this range retention values are found to be independent of stock consistency. Polymers used in all the experiments were diluted to 1% for coagulants and phenolic enhancerphenolic enhancer, and 0.1% for flocculants. The Britt Jar impeller was operated at approximately 800 revolutions per minute.

The Britt Jar test is used to duplicate paper machine retention aimed at the effect of colloidal factors on retention rather than hydromechanical factors, ie, attraction or repulsion forces rather than physical entrapment of fines and mechanical entanglement of fibers. Thus measured retention values do not contain the factor related to filtration and represent true chemical retention component.

Each test was conducted by placing the stock in the upper chamber and then subjecting the stock to the following sequences as outlined:

Single and Dual polymer program:

0 seconds—add stock 5 seconds—add coagulant (for dual polymer programs only)

10 seconds—add flocculant 15 seconds—start collecting white water sample

Experiments with phenolic enhancer:

0 seconds—add stock 5 seconds—add coagulant (optional)

10 seconds—add phenolic enhancer 15 seconds—add flocculant 20 seconds—start collecting the white water sample A 100 ml sample of white water collected from each test was filtered through the Whatman 41 filter paper and the time required for first dry spot to appear on the filter paper was measured, providing the SD for that sample. Consistency of white water $C_{ww}$ and filler consistency of white water $C_{fww}$ were then measured after drying and ashing the filter pad. These values were then used to calculate FPR and FPAR.

2. Alchem Drainage Test for evaluation of performance of phenolic enhancer

The Alchem Drainage Tester is used to study the static free drainage and retention of paper stocks. The improved drainage expected with is examined using this test. Alchem Drainage Tester is a baffled plastic cylinder equipped with a 50 mesh screen. A sample of stock is first treated in the Britt Jar, mimicking the sequence of the addition of additives and the application shear in the paper machine. At the end of each test, the sample is, without draining, transferred to the Alchem Drainage Tester. After the stopper closing the tester is released, the volume of the filtrate collected during a 5 second period is measured.

3. Jar Test used for evaluation of performance of studied programs in Save-all and Clarifier applications.

The jar test used for water clarification to establish chemical dosages required for settling out solids in the event a clarifier is not in operation was completed on various samples.

This test is performed using a gang stirrer. A 500 ml sample of the stock is placed in a beaker and is being treated with the solutions of polymers in a manner reflecting actual application. After the agitator is turned off, a sample of supernatant is collected and its turbidity measured.

The turbidity of collected white water is an indication of retention. The turbidity of the filtrate is inversely proportional to retention performance. The lower the turbidity value, the higher the retention of filler and/or fines. The turbidity values were determined using a Hach Turbidimeter.

4. Sludge Dewatering Test:

Equipment to perform this test consists of a screen from a sludge press, a metal ring, a large funnel, and a volumetric cylinder. A sample of the sludge is treated in the beaker with the appropriate dosage of polymer. The total dosage of polymers should be delivered in the 50 ml volume so the total volume of sludge is unchanged. Sludge is being treated in the beaker and mixed by pouring from one beaker to another. 3–6 such cycles should be done depending on the plant conditions. Treated sample of sludge is then transferred into the ring placed on the screen over the funnel and volumetric cylinder. The volume drained at the end of 5, 10 and 20 second concurrent time periods beginning from the time of transfer is measured.

The test for sludge dewatering allows comparisons between different treatment programs and their abilities to dewater a specific sludge sample. This test may also be used to indicate floc stability.

Sludge dewatering is the removal of water from wastewater treatment solids (sludge) in quantities greater than is achieved by thickening. The dewatering can be done using mechanical processes or land application. Sludge dewatering involves the removal of free water and capillary water from the sludge. Free water drains easily from the solid particles present since no adhesive or capillary forces need to be overcome. Capillary water can be separated from solids by overcoming adhesive or capillary forces and is typically removed in pressure sections. Chemical sludge conditioning is practiced ahead of dewatering to build floc particles size for increased water removal.

The following examples are presented to describe preferred embodiments and utilities of the invention and are not meant to limit the invention unless otherwise stated in the claims appended hereto.

EXAMPLES

Unless otherwise specified, the phenolic enhancer utilized in each of these examples was a phenol formaldehyde resin.

Example 1

Table 1 presents data gathered from experiments with newsprint furnish. The furnish was prepared using thick stock thermomechanical pulp (TMP) sample with about 20% (precipitated calcium carbonate) PCC as a filler. The thick stock sample was diluted to the testing consistency with tap water. The pH of the stock was about 7, although results using kaolin clays at pHs about 5.5 were similar. In Table 1, the dosage of flocculant is 3 kg/t and the dosage of phenol-formaldehyde resin (PFR) is 3 kg/t. The dosages cited in refers to the dosage of the product.

The nonionic flocculant was a non-ionic latex inverse emulsion homopolymer acrylamide having total solids of 27.2% and an RSV of 30.0 dl/g commercially available from Nalco Chemical Company in Naperville, Ill. The phenolic enhancer was received as a 41.5% solids from Borden Chemical Co. in Sheboygan, Wis. The phenolic enhancer was added prior to the flocculent. Clearly, the addition the phenolic enhancer improves the suction drainage, the total retention and the ash retention.

TABLE 1

The effect of phenol enhancer on retention and drainage in a newsprint TMP furnish

| | SD (s) | FPR (%) | FPAR (%) |
|---|---|---|---|
| Flocculant[1] only | 51 | 57 | 8 |
| Phenolic Enhancer[2]/Flocculant[1] | 23 | 72 | 42 |

[1]= poly(acrylamide)

[2]= phenol-formaldehyde resin

Example 2

Table 2 present data gathered from experiments with newsprint furnish. The furnish was prepared using thick stock TMP sample with about 20% PCC as a filler. The thick stock sample was diluted to the testing consistency with tap water. The pH of the stock as about 7, although results using kaolin clays at pHs about 5.5 were similar. In Table 2, the dosage of flocculant is 3 kg/t the dosage of phenolic enhancer is 3 kg/t, and the dosage of coagulant is 2kg/t.

The flocculant was a medium charge anionic latex inverse emulsion acrylamide/acrylic acid copolymer having total solids of 29% and an RSV of 32.0 dl/g commercially available from Nalco Chemical Company in Naperville, Ill. The coagulant was a high-charge condensation polymer formed from epichlorohydrin and dimethylamine having total solids of 47% and an IV of 0.15 dl/g commercially available from Nalco Chemical Company in Naperville, Ill.

The phenolic enhancer was received as a 41.5% solids from Borden Chemical Co. in Sheboygan, Wis. The phenolic enhancer was added before the flocculant. The addition the phenolic enhancer in combination with the flocculant improves the suction drainage. Clearly, upon introduction of a coagulant into the flocculant/enhancer treatment an improvement in total retention and ash retention is observed.

TABLE 2

The effect of phenol enhancer on retention and drainage in a newsprint TMP furnish

| | SD (s) | FPR (%) | FPAR (%) |
|---|---|---|---|
| Flocculant[1] only | 37 | 60 | 22 |
| Phenolic Enhancer[2]/Flocculant[1] | 27 | 62 | 24 |
| Coagulant[3]/Flocculant[1] | 11 | 66 | 34 |
| Coagulant/Phenolic Enhancer[2]/Flocculant[1] | 11 | 72 | 50 |

[1]= poly(acrylamide/acrylic acid)
[2]= phenol-formaldehyde resin
[3]= epichlorohydrin/dimethylamine condensation polymer

Example 3

Table 3 shows data gathered from experiments with fine paper furnish. The stock sample used was taken from a fine paper mill. Additional PCC was added to increase the filler level. While PCC was used, any other filler typically used in paper making processes could be used As used herein, the values presented are Suction Drainage (SD), First Pass Retention (FPR) and First Pass Ash Retention (FPAR).

In Table 3, the dosage of flocculant is 3 kg/t and the dosage of phenol-formaldehyde resin (PFR) is 3 kg/t.

The nonionic flocculant was a latex inverse emulsion homopolymer acrylamide having total solids of 27.2% and an RSV of 30.0 dl/g commercially available from Nalco Chemical Company in Naperville, Ill. The phenolic enhancer, was received as a 41.5% solids from Borden Chemical Co. in Sheboygan, Wis. The phenolic enhancer was added prior to flocculant addition. Clearly, the addition the phenolic enhancer improves the suction drainage, the total retention and the ash retention.

TABLE 3

The effect of phenolic enhancer on retention and drainage in a fine paper furnish

| | SD (s) | FPR (%) | FPAR (%) |
|---|---|---|---|
| Flocculant[1] only | 91 | 82 | 49 |
| Phenolic Enhancer[2]/Flocculant[1] | 33 | 94 | 83 |

[1]= poly(acrylamide)
[2]= phenol-formaldehyde resin

Example 4

Table 4 shows data gathered from experiments with a recycled board furnish. The values presented are Suction Drainage (SD), First Pass Retention (FPR) and First Pass Ash Retention (FPAR). In Table 4, the dosage of flocculent is 3 kg/t and the dosage of phenol-formaldehyde resin (PFR) is 3 kg/t.

The nonionic flocculant was a latex inverse emulsion homopolymer acrylamide having total solids of 27.2% and an RSV of 30.0 dl/g commercially available from Nalco Chemical Company in Naperville, Ill. The phenolic enhancer, was received as a 41.5% solids from Borden Chemical Co. in Sheboygan, Wis. The phenolic enhancer was added prior to flocculant addition. Clearly, the addition of the phenolic enhancer dramatically improves the suction drainage, the total retention and the ash retention.

TABLE 4

The effect of phenolic enhancer on retention and drainage in recycled board furnish

| | SD (s) | FPR (%) | FPAR (%) |
|---|---|---|---|
| Flocculant[1] only | 81 | 77 | 38 |
| Phenolic Enhancer[2]/Flocculant[1] | 8 | 93 | 84 |

[1]= poly(acrylamide)
[2]= phenol-formaldehyde resin

Example 5

Table 5–6 presents data gathered from experiments with newsprint furnish. Table 5 presents the total retention results for these experiments while table 6 displays the results of ash retention for the described experiments. The furnish was prepared using thick stock TMP sample with about 20% PCC as a filler. The thick stock sample was diluted to the testing consistency with tap water. The pH of the stock as about 7, although results using kaolin clays at pHs about 5.5 were similar. In Tables 5–6, the dosage of flocculant is 1 kg/t, the dosage of tannin extract 4 kg/t, and the dosage of coagulant is 1 kg/t.

The nonionic flocculant was a latex inverse emulsion homopolymer acrylamide having total solids of 27.2% and an RSV of 30.0 dl/g commercially available from Nalco Chemical Company in Naperville, Ill. The coagulant was a high-charge condensation polymer formed from epichlorohydrin and dimethylamine having total solids of 47% and an IV of 0.15 dl/g commercially available from Nalco Chemical Company in Naperville, Ill. The tannin extract is a 15% actives product available from Nalco Chemical Company in Naperville, Ill. The tannin extract was added prior to flocculant addition. The addition the tannin extract in combination with the flocculant improves the total retention and the ash retention, displayed in Tables 5–6 respectively. Furthermore, clearly upon introduction of a coagulant into the flocculant/enhancer treatment a further improvement in total retention and ash retention is observed as evidenced from the data in Tables 5–6, respectively.

TABLE 5

The effect of tannin extract on the FPR in a newsprint TMP furnish

| | Flocculant[1] | Tannin[2]/Flocculant[1] | Coagulant[3]/Tannin[2]/Flocculant[1] |
|---|---|---|---|
| FPR | 54 | 79 | 87 |

[1]= poly(acrylamide), 3 kg/t
[2]= tannin extract
[3]= condensation polymer of epichlorohydrin and dimethylamine

TABLE 6

The effect of tannin extract on FPAR in a newsprint TMP furnish containing 19% PCC

| | Flocculant[1] | Tannin[2]/Flocculant[1] | Coagulant[3]/Tannin[2]/Flocculant[1] |
|---|---|---|---|
| FPAR | 14 | 67 | 81 |

[1]= poly(acrylamide), 3 kg/t
[2]= phenol formaldehyde resin
[3]= condensation polymer of epichlorohydrine and dimethylamine Example 7

Table 7 presents data gathered from experiments with newsprint furnish. The furnish was prepared using thick stock TMP sample with about 20% PCC as a filler. The thick stock sample was diluted to the testing consistency with tap water. The pH of the stock as about 7, although results using kaolin clays at pHs about 5.5 were similar. In Table 7, the dosage of flocculant is 3 kg/t, the dosage of phenolic enhancer is 3 kg/t, and the dosage of coagulant is 2kg/t.

The nonionic flocculant was a latex inverse emulsion homopolymer acrylamide having total solids of 27.2% and an RSV of 30.0 dl/g commercially available from Nalco Chemical Company in Naperville, Ill. The coagulant was a high-charge epichlorohydrin-dimethyamine polymer having total solids of 47% and an IV of 0.15 dl/g commercially available from Nalco Chemical Company in Naperville, Ill. The phenolic enhancer, was received as a 41.5% solids from Borden Chemical Co. in Sheboygan, Wis. The phenolic enhancer was added before the flocculant. The order of addition was coagulant, phenolic enhancer and then flocculant. The addition the phenolic enhancer in combination with the flocculant improves the suction drainage, total retention and ash retention. Furthermore, clearly upon introduction of a coagulant into the flocculant/enhancer treatment a further improvement in suction drainage, total retention, and ash retention is observed.

TABLE 7

The effect of coagulant on phenolic enhancer performance in a newsprint TMP furnish

| | SD (s) | FPR (%) | FPAR (%) |
|---|---|---|---|
| Flocculant[1] only | 51 | 57 | 8 |
| Phenolic Enhancer[2]/Flocculant[1] | 23 | 72 | 42 |
| Coagulant[3]/Flocculant[1] | 33 | 58 | 11 |
| Coagulant[3]/Phenolic Enhancer[2]/Flocculant[1] | 11 | 77 | 58 |

[1]= poly(acrylamide)
[2]= phenol formaldehyde resin
[3]= epichlorohydrin/dimethylamine condensation polymer Example 8

Table 8 present data gathered from experiments with a peroxide bleached newsprint furnish. The thick stock sample was diluted to the testing consistency with tap water. The pH of the stock as about 7. In Table 8, the dosage of flocculant is 0.5 kg/t, the dosage of phenolic enhancer (phenol formaldehyde resin) is 4 kg/t.

The nonionic flocculant was a latex inverse emulsion homopolymer acrylamide having total solids of 27.2% and an RSV of 30.0 dl/g commercially available from Nalco Chemical Company in Naperville, Ill. The coagulant was the inorganic coagulant alum available from Nalco Chemical Company in Naperville, Ill. The phenolic enhancer, was received as a 41.5% solids from Borden Chemical Co. in Sheboygan, Wis. The order of addition was coagulant, phenolic enhancer, and then flocculant. Clearly, the addition of alum improves the total retention of the phenolic enhancer nonionic polymer treatment.

TABLE 8

Effect of Inorganic Coagulant on Britt Jar first pass retention

| Inorganic Coagulant Dose (kg/t) | First Pass Retention (%) |
|---|---|
| No Program | 63 |
| 0 | 75 |
| 10 | 78 |
| 15 | 86 |

Example 9

Table 9 presents data gathered from experiments with a peroxide bleached newsprint furnish. The thick stock sample was diluted to the testing consistency with tap water. The pH of the stock as about 7.In Table 9, the dosage of flocculant is 0.5 kg/t the dosage of phenolic enhancer (phenol formaldehyde resin) is 4 kg/t.

The nonionic flocculant was a latex inverse emulsion homopolymer acrylamide having total solids of 27.2% and an RSV of 30.0 dl/g commercially available from Nalco Chemical Company in Naperville, Ill. The coagulant was a high-charge condensation polymer of epichlorohydrin and dimethylamine having total solids of 47% and an IV of 0.15 dl/g commercially available from Nalco Chemical Company in Naperville, Ill. The phenolic enhancer, was received as a 41.5% solids from Borden Chemical Co. in Sheboygan, Wis. The order of addition was coagulant, phenolic enhancer, and then flocculant. Clearly, the addition of organic coagulant improves the total retention of the phenolic enhancer nonionic polymer treatment.

TABLE 9

Effect of Organic Coagulant on Britt Jar first pass retention

| Organic Coagulant Dose (kg/t) | First Pass Retention (%) |
|---|---|
| No Program | 63 |
| 0 | 77 |
| 2 | 83 |
| 4 | 86 |

Example 10

Tables 10–11 presents data gathered from experiments with another peroxide bleached newsprint furnish. The thick stock sample was diluted to the testing consistency with tap water. The pH of the stock as about 7. The furnish was filled with 20% clay. In Table 9, the dosage of flocculant is 0.5 kg/t, the dosage of phenolic enhancer is 4 kg/t.

The nonionic flocculant was a latex inverse emulsion homopolymer acrylamide having total solids of 27.2% and an RSV of 30.0 dl/g commercially available from Nalco Chemical Company in Naperville, Ill. The coagulant was a high-charge condensation polymer formed from epichlorohydrindimethylamine having total solids of 47% and an IV of 0.15 dl/g commercially available from Nalco Chemical Company in Naperville, Ill. The phenolic enhancer (phenol formaldehyde resin), was received as a 41.5% solids from Borden Chemical Co. in Sheboygan, Wis. The order of addition was coagulant, phenolic enhancer, and then flocculant. Clearly, the addition of organic coagulant improves the total retention as well as the ash retention of the phenolic enhancer nonionic polymer treatment as shown in Tables 10–11, respectively.

TABLE 10

Effect of Organic Coagulant on Britt Jar first pass retention

| Organic Coagulant Dose (kg/t) | First Pass Retention (%) |
|---|---|
| No Program | 63 |
| 0 | 77 |
| 2 | 83 |
| 4 | 86 |

TABLE 11

Effect of Organic Coagulant on Britt Jar first pass ash retention

| Organic Coagulant Dose (kg/t) | First Pass Retention (%) |
|---|---|
| No Program | 46 |
| 0 | 47 |
| 6 | 60 |
| 12 | 82 |

Example 11

A sample of recycled board was used in determining the performance of low charge cationic flocculants and nonionic flocculant in the presence of phenol-formaldehyde resin for clarifier applications. The results are recorded in Table 12. The dosages of flocculant and phenolic enhancer are 4 ppm. The test has been previously defined.

The nonionic flocculant was a latex inverse emulsion homopolymer acrylamide having total solids of 27.2% and an RSV of 30.0 dl/g commercially available from Nalco Chemical Company in Naperville, Ill. The low charge cationic flocculant tested was a copolymer of acrylamide and dimethylaminoethylacrylate methyl chloride quaternary salt having total solids of 36% and an RSV of 19 dl/g commercially available from Nalco Chemical Company in Naperville, Ill. The phenolic enhancer (phenol formaldehyde resin), was received as a 41.5% solids from Borden Chemical Co. in Sheboygan, Wis. The order of addition was phenolic enhancer and then flocculant. Clearly, the addition of phenolic enhancer improves the clarity obtained using either the nonionic or low-charge cationic flocculant treatments alone.

TABLE 12

The effect of phenolic enhancer on performance in water clarifier applications

| | Turbidity (no coagulant) | Turbidity (added coagulant) |
|---|---|---|
| Flocculant only | 103 | 88 |
| Phenolic Enhancers/Flocculant | 87 | 67 |

Example 12

A sample from a recycled board mill was used in determining the performance of nonionic flocculant in the presence of phenol-formaldehyde resin for sludge dewatering applications. The results are recorded in Table 13. The dosages of flocculant and phenolic enhancer are 2 kg/t. The test has been previously defined.

The nonionic flocculant was a latex inverse emulsion homopolymer acrylamide having total solids of 27.2% and an RSV of 30.0 dl/g commercially available from Nalco Chemical Company in Naperville, Ill. The phenolic enhancer, was received as a 41.5% solids from Borden Chemical Co. in Sheboygan, Wis. The order of addition was phenolic enhancer and then flocculant. Clearly, the addition of phenolic enhancer dramatically improves the dewatering rate obtained using the nonionic flocculant treatment alone.

TABLE 13

The effect of phenolic enhancer on sludge dewatering application in a recycled board mill

| | 5-sec Drainage volume (ml) | 10-sec Drainage volume (ml) | 15-sec Drainage volume (ml) |
|---|---|---|---|
| Flocculant only | 85 | 110 | 145 |
| Phenolic enhancer/flocculant | 155 | 215 | 295 |

Example 13

A sample of saveall stock from a fine paper fill was used in determining the performance of a high-charge cationic flocculants in the presence of phenol-formaldehyde resin for saveall clarifier applications. The results are recorded in Table 14. The dosages of flocculant is 4ppm and phenolic enhancer dose is 2 ppm. The test has been previously defined.

The high-charge cationic flocculant tested was a copolymer of dimethylaminoethylacrylate methyl chloride quaternary salt having total solids of 36% and an RSV of 18 dl/g commercially available from Nalco Chemical Company in Naperville, Ill. The phenolic enhancer, was received as a 41.5% solids from Borden Chemical Co. in Sheboygan, Wis. The order of addition was phenolic enhancer and then flocculant. Clearly, the addition of phenolic enhancer improves the clarity obtained using the high-charge cationic flocculant treatments alone.

TABLE 14

The effect of phenolic enhancer on performance in save-all stock from a fine paper mill (Turbidity)

| | Turbidity (NTU) |
|---|---|
| Flocculant only | 57 |
| Phenolic Enhancer/Flocculant | 27 |

Changes can be made in the composition, operation and arrangement of the method of the present invention described herein without departing from the concept and scope of the invention as defined in the following claims:

We claim:

1. A method for increasing retention of fiber and filler and improving the drainage of water from a papermaking furnish during the formation of a cellulosic sheet which comprises:

A. Adding to the furnish i. from about 0.003 to about 1.0% by weight based on total solids in the furnish of a phenolic enhancer selected from the group consisting of: phenol-formaldehyde resins, tannin extracts, naphthol-formaldehyde condensates, poly(para-vinyl phenol) and mixtures thereof, and, ii. from about 0.003 to about 0.5% by weight based on total solids in the slurry of an anionic flocculant; and then, B. Forming the cellulosic sheet whereby the retention of fillers and fiber on the sheet is increased, and the drainage of water from the sheet is improved.

2. The method according to claim 1 wherein the furnish is selected from the group consisting of those used to prepare fine paper, board, and newsprint.

3. The method of claim 1 wherein the phenolic enhancer is added to the furnish after the flocculant.

4. The method of claim 1 wherein the phenolic enhancer is added to the furnish prior to the flocculant.

5. The method according to claim 1 further comprising the addition of a coagulant to the furnish in an amount from about 0.001 to about 4% by weight based on total solids in the furnish before adding the flocculant to the furnish.

6. The method according to claim 5 wherein the coagulant is selected from the group consisting of cationic water soluble polymers and alum.

7. The method according to claim 1 further comprising the addition to the furnish of an effective anionic trash controlling amount of a composition selected from a group consisting of: bentonite, talc, and mixtures thereof.

* * * * *